US008548184B2

(12) United States Patent
Werner

(10) Patent No.: US 8,548,184 B2
(45) **Date of Patent: *Oct. 1, 2013**

(54) CONSTANT COVERAGE WAVEGUIDE

(75) Inventor: Bernard M. Werner, Los Angeles, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 165 days.

This patent is subject to a terminal disclaimer.

(21) Appl. No.: 13/098,671

(22) Filed: May 2, 2011

(65) Prior Publication Data

US 2011/0274305 A1 Nov. 10, 2011

Related U.S. Application Data

(63) Continuation of application No. 10/046,404, filed on Jan. 14, 2002, now Pat. No. 7,936,892.

(51) Int. Cl.
*H04R 25/00* (2006.01)

(52) U.S. Cl.
USPC ..... 381/338; 381/340; 181/177; 181/192

(58) Field of Classification Search
USPC ..... 381/337–344; 181/177, 187–188, 181/192–195
See application file for complete search history.

(56) References Cited

U.S. PATENT DOCUMENTS

| | | | | |
|---|---|---|---|---|
| 1,652,655 | A | 12/1927 | Alexander | |
| 1,996,743 | A | 4/1935 | Blattner | |
| 2,537,141 | A | 1/1951 | Klipsch | |
| 2,690,231 | A | 9/1954 | Levy et al. | 181/27 |
| 2,761,913 | A | 9/1956 | Manley | |
| 3,930,561 | A | 1/1976 | Klayman | |
| 4,130,023 | A | 12/1978 | Henricksen | |
| 4,152,552 | A | 5/1979 | Meyer | |
| 4,171,734 | A | 10/1979 | Peveto et al. | |
| 4,176,731 | A | 12/1979 | Sinclair | |
| 4,180,710 | A | 12/1979 | Spranger | |
| 4,187,926 | A | 2/1980 | Henricksen et al. | |
| 4,206,831 | A | 6/1980 | Welch et al. | |
| 4,308,932 | A | 1/1982 | Keele, Jr. | |
| 4,324,312 | A | 4/1982 | Durbin | |
| 4,325,456 | A | 4/1982 | Ureda | |
| 4,344,504 | A | 8/1982 | Howze | |
| 4,390,078 | A | 6/1983 | Howze et al. | |
| 4,554,414 | A | 11/1985 | House | |
| 4,580,655 | A | 4/1986 | Keele, Jr. | |
| 4,580,665 | A | 4/1986 | Saxton et al. | |
| 4,629,029 | A | 12/1986 | Gunness | |

(Continued)

OTHER PUBLICATIONS

International Preliminary Examination Report, dated Feb. 5, 2004, pp. 1-4, International Patent Application No. PCT/US02/41223, International Preliminary Examining Authority, Virginia.

(Continued)

*Primary Examiner* — Mohammad Islam
*Assistant Examiner* — Phylesha Dabney
(74) *Attorney, Agent, or Firm* — Brinks Hofer Gilson & Lione

(57) ABSTRACT

This invention provides an acoustic waveguide with a continuous least-energy-surface formed from an upper vertical control curve, a lower vertical control curve, right horizontal control curve and a left horizontal control curve. In addition, a circular throat end and a non-elliptical closed control curve form a mouth such that the continuous least-energy-surface is coincident with the six control curves.

11 Claims, 5 Drawing Sheets

(56) References Cited

U.S. PATENT DOCUMENTS

| | | | |
|---|---|---|---|
| 4,685,532 | A | 8/1987 | Gunness |
| 4,975,965 | A | 12/1990 | Adamson |
| 5,020,630 | A | 6/1991 | Gunness |
| 5,224,196 | A | 6/1993 | Khanarian et al. |
| 5,233,136 | A | 8/1993 | Hamada |
| 5,526,456 | A | 6/1996 | Heinz |
| 5,533,132 | A | 7/1996 | Button |
| 5,602,930 | A | 2/1997 | Walton |
| 5,784,474 | A | 7/1998 | Kohut et al. |
| 5,821,470 | A | 10/1998 | Meyer et al. |
| 5,892,183 | A | 4/1999 | Roozen et al. |
| 5,925,856 | A | 7/1999 | Meyer et al. |
| 6,009,182 | A | 12/1999 | Gunness |
| 6,016,353 | A | 1/2000 | Gunness |
| 6,081,602 | A | 6/2000 | Meyer et al. |
| 6,094,495 | A | 7/2000 | Rocha |
| 6,118,883 | A | 9/2000 | Rocha |
| D452,964 | S | 1/2002 | Vosse |
| 6,343,133 | B1 | 1/2002 | Adamson |
| 7,039,211 | B2 | 5/2006 | Werner |
| 7,936,892 | B2 | 5/2011 | Werner |
| 2009/0310808 | A1 | 12/2009 | Button et al. |

OTHER PUBLICATIONS

Geddes, Earl R.; Acoustic Waveguide Theory; Journal of the Audio Engineering Society; vol. 37, No. 7/8, Jul./Aug. 1989; 554-569.

Patronis, Gene; Compression Drivers and Horns; Presented at 1995 SynAudCon Workshop (date unknown), Syergegetic Audio Concepts, Inc., Greenville, IN.

Beranek, Leo L.; Horn Loudspeakers; pp. 259-284 (Chapter 9), 1993 edition; Bolt Bernek and Newmen, Inc., Cambridge, MA.

Smith et al., "Improvements in Monitor Loudspeaker Systems", Jun. 1983, Journal of the Audio Engineering Society, vol. 31, No. 6, pp. 408-422.

CONSTANT COVERAGE WAVEGUIDE

CROSS-REFERENCE TO RELATED APPLICATIONS

This application is a continuation of and claims priority to U.S. application Ser. No. 10/046,404, filed on Jan. 14, 2002, titled CONSTANT COVERAGE WAVEGUIDE, which application is incorporated by reference in this application in its entirety.

TECHNICAL FIELD

This invention relates to loudspeaker horns, and in particular, to acoustic waveguides.

RELATED ART

Typically, loudspeaker horns consist of a driving unit that is coupled to a horn. The large end of the horn, called the "mouth," typically has an area large enough to radiate sound efficiently at a desired low frequency. The small end of the horn, called the "throat," has an area selected to match the acoustic impedance and exit diameter of the driving unit and to reduce distortion of the acoustic signal.

The loudspeaker horn is a directional control device that guides the acoustic signal or acoustic energy into particular directions or regions. The loudspeaker horn surfaces that constrain and control the radiation of acoustic energy are commonly referred to as an acoustic waveguide. The surfaces of an acoustic waveguide in a loudspeaker typically produce a coverage pattern of a specified total coverage angle that may differ horizontally and vertically. The coverage angle is a total angle in any plane of observation (although typically horizontal and vertical orthogonal planes are used). The coverage angle is evaluated as a function of frequency and is defined to be the angle at which the intensity of sound (Sound Pressure Level—SPL) is half of the SPL on the axis (the reference axial direction usually normal to the throat of the driver). Such a coverage pattern is desirable because it conforms to general audience seating patterns, for example seating patterns found in theaters, sports arenas and concert halls.

An acoustic waveguide defines a bounded region that directs the sound from the throat to the mouth of a horn with the throat being narrower than the mouth in both the primary horizontal and vertical planes. Acoustic energy radiates into the throat from the driver at high pressure, with a wave front that is nominally flat and free of curvature. As the wave front expands outward to the mouth of the horn or acoustic waveguide, the axial area increases in a uniform and monotonically increasing fashion controlled by an area expansion function designed to provide high acoustic impedance (or radiation resistance) at the throat.

The determined area expansion rate creates a uniform radiation impedance as a function of frequency to theoretically lower limit in frequency. The uniformly increasing area from the throat to the mouth yields a decreasing pressure gradient that couples the output of the driver to the free atmosphere. The free atmosphere provides low radiation impedance. This coupling of high acoustic impedance source to a low impedance load (the air surrounding the acoustic waveguide) provides an action analogous to an electrical transformer. The winding ratio is equivalent to the ratio of radiation resistance seen by the driver and the radiation resistance of the unrestricted surrounding, atmosphere. In this analogy the drop in pressure from the throat to the mouth of the horn is equivalent to the voltage drop across a step down electrical transformer.

The shape of an acoustic waveguide affects the frequency response, polar pattern and the level of harmonic distortion of sound waves as they propagate away from the acoustic waveguide. As loudspeakers produce sound waves, waveguides are used to control the characteristics of the acoustic wave propagation. Current horn approaches include acoustic waveguide designs that have extruded curves that define the horizontal and vertical curvature in sheet surfaces. Other acoustic waveguide design approaches have designs that sweep the curvature about a point in space to create a quadratic surface (such as a hyperboloid.) In these examples, the intersection of the resulting four surfaces in a horn forms an interior surface that function as the acoustic waveguide. The resulting acoustic waveguide has a circular entrance at the throat of the horn and an exit at the mouth. Current horn approaches often include a diffraction slot that is usually a rectangular slot, or a slice of a cylinder, in the throat and is defined as the narrowest width (height) of the horn surface to further control the characteristics of the acoustic wave propagation.

Constant directivity acoustic waveguide approaches have relied on curves that define the horizontal and the vertical curvature of the acoustic waveguide. The curvature in the horizontal and vertical planes fundamentally determines the frequency response (acoustic pressure as a function of frequency), as well as the acoustic polar pattern, or radiation pattern, of the acoustic waveguide and the level of harmonic distortion the acoustic waveguide creates due to the non-linear behavior of the air at high pressures.

A constant coverage acoustic waveguide may be realized if the walls and expansion of the acoustic waveguide form a solution to the equations typically referred to as "Laplace's Wave Equation" by persons skilled in the art. Solving this equation for an acoustic waveguide of a desired coverage angle, and depth, and mouth dimension determines, the correct area expansion rate in order for the wave front to remain perpendicular to, and attached to the sidewalls of the acoustic waveguide. As a result a diffraction slot is not required, and the compromises in performance are avoided.

However the "solution" is limited to axis-symmetric acoustic waveguides that are simply surfaces of revolution formed by a single, two-dimensional curve, i.e. horns having round throat and round mouths, about the primary axis. As a result the coverage pattern of such devices is equal in both the horizontal and vertical planes, as well as at any intermediate plane between the two that pass through the primary axis.

Other approaches that realize approximate solutions for acoustic waveguides with coverage angles that differ in the horizontal and vertical planes, are typically formed from elliptical hyperbolas having three-dimensional surfaces that include a round throat and a closed elliptical mouth. The elliptical shape is used to approximate the solution to the wave equation because a circle is an ellipse with both the major and minor diameters equal to the diameter of the circle. From a practical standpoint this solution is non-ideal, as it does not use the available surface area of the mouth of the acoustic waveguide.

What is needed in the art is an acoustic waveguide that enables a wave front to expand smoothly and remain "attached" to the sidewall of the acoustic waveguide, without relying on geometric diffraction to produce constant directivity or constant coverage.

SUMMARY

This invention provides an approach to the design of a constant coverage waveguide that has a circular or round throat and a mouth that may be formed to have an arbitrary non-elliptical closed shape. The shape of the mouth may include a rectangular or square, or any other shape that may be formed from a mathematically continuous and closed two-dimensional or three-dimensional curve. The result is an acoustic waveguide with a desired shape to the wave front radiating from the mouth of the acoustic waveguide and resulting in a desirable three-dimensional radiation characteristic. The surface of the acoustic waveguide that results may be controlled by a group of two-dimensional curves that minimizes the presence of mathematical discontinuities. The curves may appear on the horizontal and vertical planes, and are typically mirror imaged about an axis of symmetry. The overall surface may also be controlled by the four two-dimensional curves described, in addition to the radius (circle) that forms the throat as a curve, and an arbitrary non-elliptical closed control curve that forms the mouth. The resulting surface forms the acoustic waveguide having a continuous, mathematically least-energy-surface and that passes through the six control curves described.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

Figure 1:
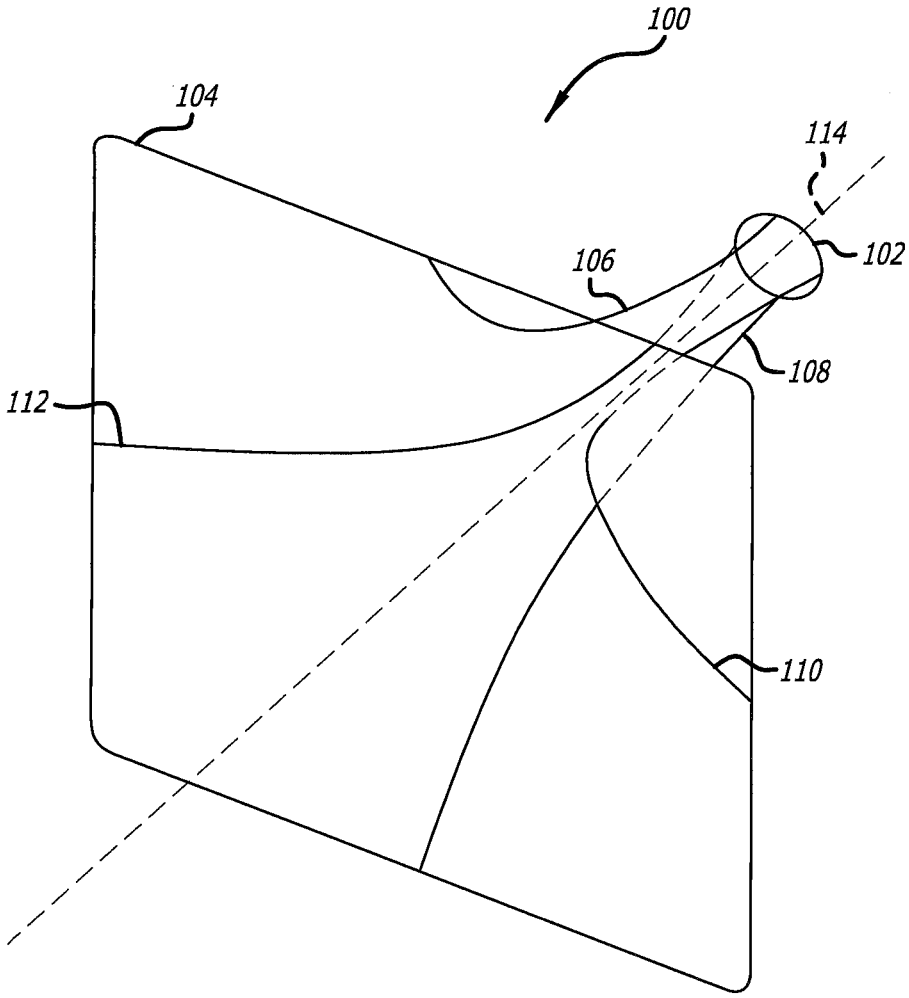
FIG. 1 is a perspective view illustrating an acoustic waveguide farmed by a continuous three-dimensional curved surface.

FIG. 1 illustrates an acoustic waveguide 100 formed by a continuous three-dimensional curved surface. The acoustic waveguide has a circular throat end 102 and a closed control curve that forms a mouth 104. The form of the acoustic waveguide may have an upper vertical control curve 106, a lower vertical control curve 108, a right horizontal control curve 110, and a left horizontal control curve 112. Each control curve may be coincident with the surface of the acoustic waveguide in addition to the circular throat end 102 and the closed control curve that forms the mouth 104. The right horizontal control curve 110 and left horizontal control curve 112 are shown converging as they move from the mouth 104 or throat end 102 and then diverging as they approach the other end of the acoustic waveguide 100. The right horizontal control curve 110 and left horizontal control curve 112 may be mirrored about an imaginary centerline 114. Similarly, the upper vertical control curve 106 and the lower vertical control curve 108 may be mirrored about the imaginary centerline 114. The control curves rest in the horizontal and vertical planes and may also be free of any discontinuities, i.e. they may be continuous curves, such as, but not limited to, convergent-divergent, rational B-spline, parabolic, hyperbolic, ellipsoidal, linear, or exponential curves.

The upper vertical, lower vertical, right horizontal, and left horizontal control curves 106, 108, 110, and 112 are each two-dimensional curves. Together, all the surfaces identified by the control curves and the circular throat 102 and closed control curve of the mouth 104 may make up a continuous three-dimensional inner surface of acoustic waveguide 100. Optimally, the minimization of mathematical discontinuities that may appear as discontinuous edges, protrusions or steps located on the inner surface of the acoustic waveguide 100 is sought. A mathematical discontinuity may appear as the mathematical local second derivative (rate of curvature) of a control curve that does not change instantly as would occur at a hard "point" or edge in a curve. Further, the midsection of the upper vertical, lower vertical, right horizontal and left horizontal control curves 106, 108, 110, and 112 respectively, are used along with the radius that forms the circular throat end 102 and mouth 104 form a "least-energy-surface" connecting the circular throat to the mouth.

A least-energy-surface may be a surface that passes through the specified controlling geometry in a manner that provides the minimum change in curvature when the rate of change of local curvature change is integrated in the mathematical sense (summed) over the entire surface. Alternately, the least-energy-surface may be mathematically one of the simplest equations representing the surface. Typically, this may be represented by the lowest order polynomial, or the factored expression with the least number of poles and zeros that causes a surface to go through the curves. The least-energy-surface in acoustic waveguide 100 is defined by the upper vertical, lower vertical, left horizontal, and right horizontal control curves 106, 108, 110 and 112 in addition to the circular throat 102 and the closed control curve of the mouth 104. Further, the acoustic waveguide 100 defined by the least-energy-surface eliminates the need for a diffraction slots. Instead the area in waveguide 100 of narrowest width or height pass through the continuous three-dimensional curved surface that allows the wave front to expand smoothly and remain attached to the side wall of the wave guide, without needing to rely on geometric diffraction to produce constant directivity or constant coverage.

Figure 2:
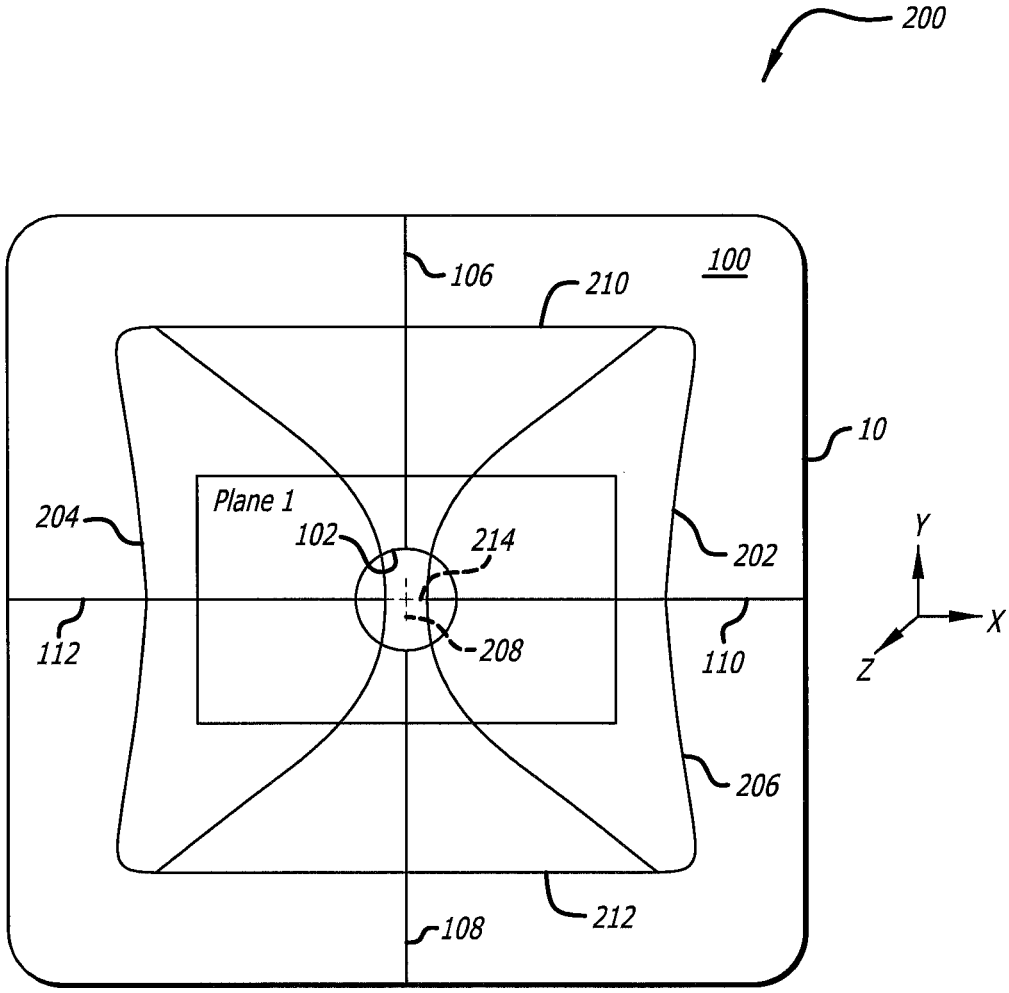
FIG. 2 is a front view illustrating the mouth of the acoustic waveguide of in FIG. 1.

FIG. 2, an axial section 200 is illustrated from a front view of the mouth 104 of the acoustic waveguide 100 of FIG. 1. The right surface portion 202 of the acoustic waveguide 100 defined, by the right horizontal control curve 110 and left surface portion 204 of the acoustic waveguide 100 formed by the left horizontal control curve 112 are each three-dimensional shapes in contact with both the circular throat end 102 and section end 206 being curved. The left surface portion 204 and the right surface portion 206 of acoustic waveguide 100 are shown as symmetrical about an imaginary line 208. Further, the upper surface portion 210 of the acoustic waveguide 100 defined by the upper vertical control curve 106 and lower surface portion 212 of the acoustic waveguide 100 defined by the lower control curve 108 are also symmetrical, but about imaginary line 214. The upper surface portion 210 and lower surface portion 212 are further defined by the circular throat end 102 and section end 206. When two surface portions meet, such as the left surface portion 204 and the upper surface portion 210, discontinuities may be minimized, thus possibly increasing performance. The two surface portions 204 and 210 are actually one continuous surface. Similarly, the other surface portions of the acoustic waveguide are part of the continuous surface.

Figure 3:
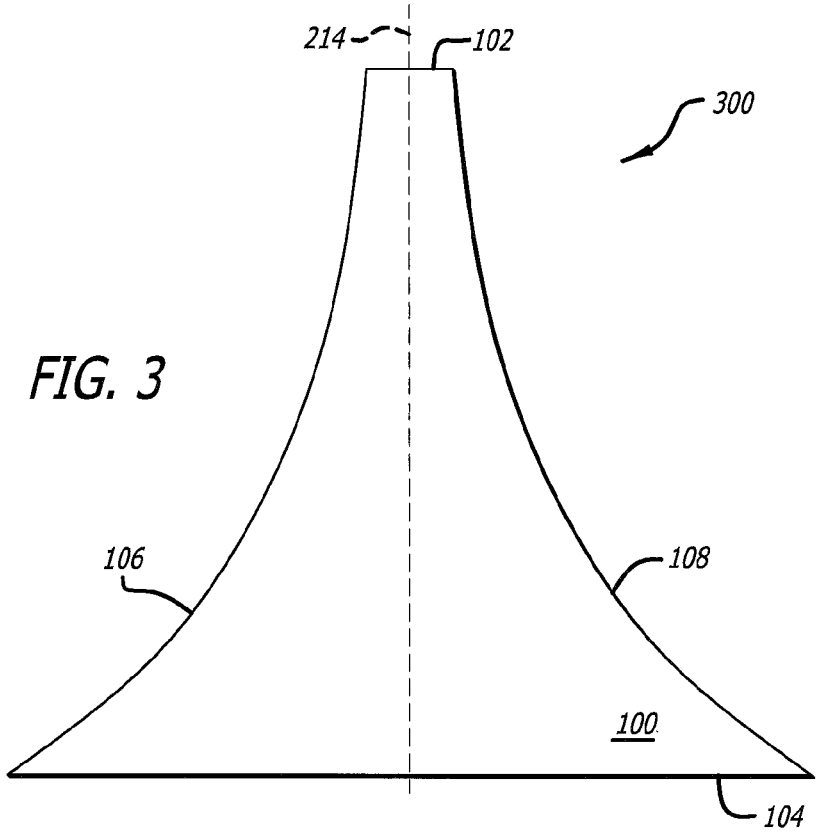
FIG. 3 is a side view illustrating the acoustic waveguide of FIG. 1.

In FIG. 3, an illustration of the elevation or side view 300 of the acoustic waveguide 100 of FIG. 1 is shown. The upper vertical control curve 106 and lower vertical control curve 108 are symmetrical about the imaginary line 214. Discontinuities may be minimized in the control curves 106 or 108 to improve performance, such that the tangent to either of the control curves 106 or 108 is always positive.

Figure 4:
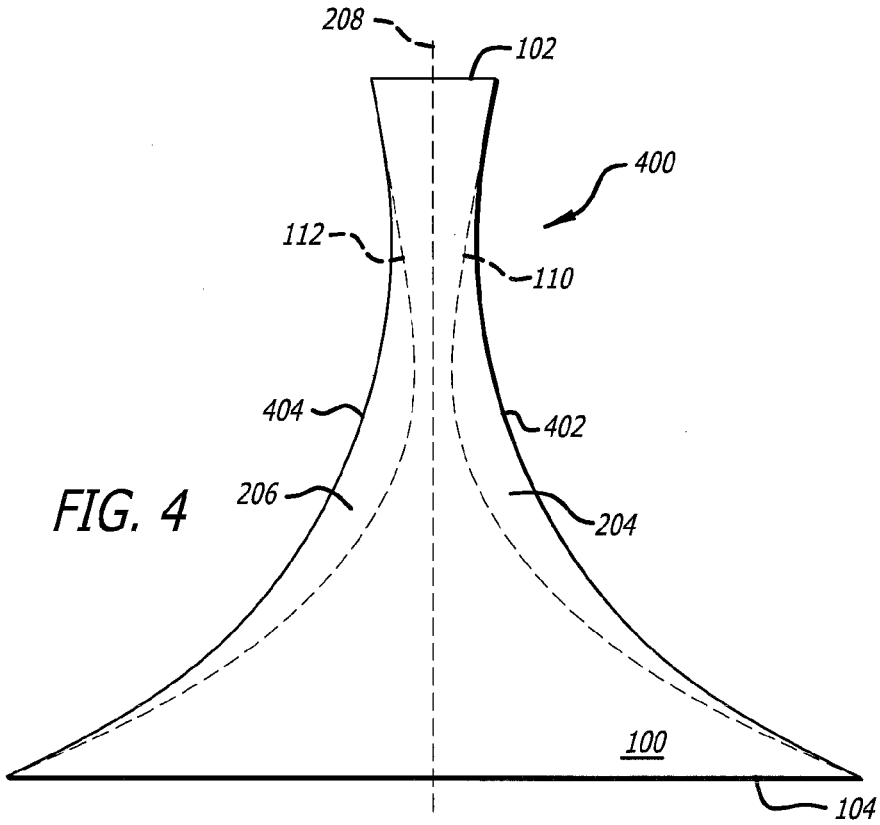
FIG. 4 is a plan or top view illustrating the acoustic waveguide of FIG. 1.

In FIG. 4, an illustration of the plane or top view 400 of the acoustic waveguide 100 of FIG. 1 is shown. The right horizontal control curve 110 and left horizontal control curve 112 may be symmetric about imaginary line 208. In an ideal embodiment, discontinuities are minimized in the control curves 110 or 112, such that the tangent to either of the control curves 110 or 112 is always positive. Because the surfaces portions formed by the right horizontal curve 110 or the left horizontal control curve 112, the circular throat end 102, and the closed control curve of the mouth 104 form a three-dimensional surface, the continuous edges 402 of the right wall 204 and the continuous edge 404 of the left 206 surface portion extend past the respective control curve 110 or 112. In an alternate embodiment, it may be possible to have continuous edges that do not extend past respective control curves.

The acoustic waveguide may be made out of plastic or similar polymer, metal, stone, or even a paper product like cardboard, with the preferred material being plastic or similar polymer. A molding, stamping or sculpting of a material to create a least-energy-surface, may form the acoustic waveguide. The acoustic waveguide surface may be made of a single continuous piece of material or from multiple pieces of materials that function as a continuous surface with minimal discontinuities after assembly.

Figure 5:
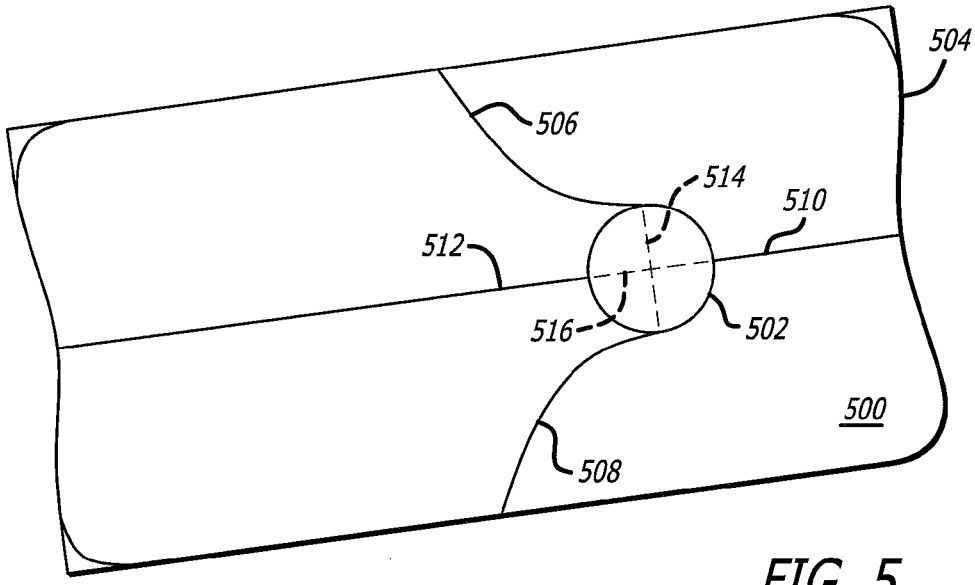
FIG. 5 is a perspective view illustrating another embodiment of an acoustic waveguide formed by a continuous three-dimensional curved surface.

In FIG. 5, an illustration of an acoustic waveguide 500 formed by a continuous three-dimensional curved surface is shown. The horn has a circular throat end 502 and a mouth 504. The surface portions that connect the circular throat end 502 and the closed control curve of a mouth 504 are identified as having an upper vertical control curve 506, a lower vertical control curve 508, a right horizontal control curve 510, and a left horizontal control curve 512. The right horizontal control curve 510 and left horizontal control curve 512 may be mirrored about an imaginary centerline 514 and are not convergent-divergent control lines. Similarly, the upper vertical control curve 506 and the lower vertical control curve 508 may be mirrored about the imaginary centerline 516. The control curves may be positioned in the horizontal and vertical planes and discontinuities may be minimized such that continuous curves may be formed. Examples include rational B-spline, parabolic, hyperbolic, ellipsesodial, or exponential curves. In a less desirable embodiment, discontinuities may appear in the surface structure, however, this may limit optimal performance. These discontinuities may also be the result of, or formed during, manufacturing processes.

The upper vertical 506, lower vertical 508, right horizontal 510, and left horizontal 512 control curves are each two-dimensional curves. Together, all the surfaces defined by the control curves create a continuous three-dimensional inner surface of acoustic waveguide 500. The upper vertical 506, lower vertical 508, right horizontal 510 and left horizontal 512 curves are used along with the radius the defines the circular throat end 502 and the non-elliptical closed control curve of the mouth 504 to form a "least-energy-surface" that connects the circular throat end 502 to the mouth 504.

The acoustic waveguide 500 formed by the least-energy-surface may eliminate the need for diffraction slots. Instead, the area in acoustic waveguide 500 of narrowest width or height pass through the continuous three-dimensional curved surface allowing the wave front to expand smoothly and remain attached to the side surface portions of the wave guide, while minimizing the reliance on geometric diffraction to produce constant directivity or constant coverage. The narrowest point in acoustic waveguide 500 may occurs at the circular throat end 502.

Figure 6:
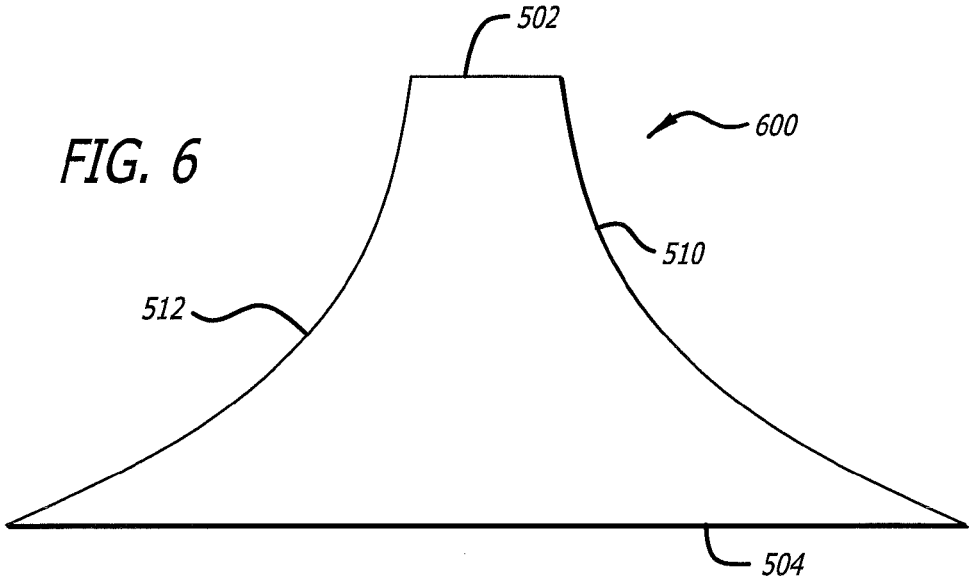
FIG. 6 is a plan or top view illustrating the acoustic waveguide of FIG. 5.

In FIG. 6, a plan or top view 600 illustrating the acoustic waveguide 500 of FIG. 5 is shown. The right horizontal 510 and left horizontal 512 control curves extend from the circular throat end 502 and a mouth 504 and are not convergent-divergent. The right horizontal 510 and left horizontal 512 control curves are closet at the circular throat end 502 and furthest apart at the mouth 504.

Figure 7:
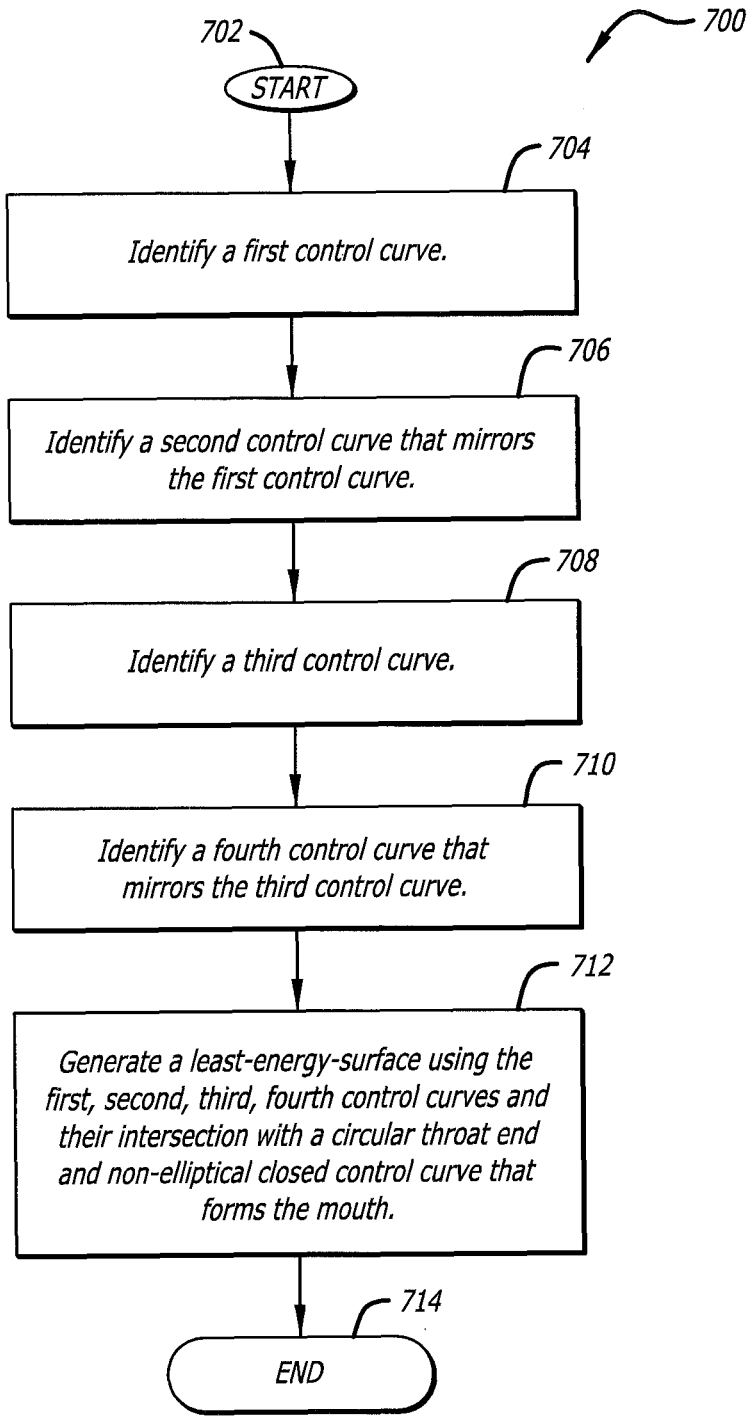
FIG. 7 is a flow diagram for forming an acoustic waveguide having a continuous three-dimensional curved surface.

FIG. 7 is a flow diagram 700 for forming an acoustic waveguide having a continuous three-dimensional curved surface. The flow diagrams starts (702) by identifying a first control curve (704) that will define an acoustic waveguide, such as acoustic waveguide 100 or 500. A second control curve is identified that mirrors the first control curve (706). A third control curve is identified (708) that mirrors a fourth control curve (710). The first, second, third, and fourth control curves intersect a circular throat end and a non-elliptical closed control curve of the mouth and generate a least-energy-surface of the acoustic waveguide (712). Upon the generation of the least-energy-surface of the acoustic waveguide, processing is complete (714).

While various embodiments of the invention have been described, it will be apparent to those of ordinary skill in the art that many more embodiments and implementations are possible that are within the scope of this invention.

What is claimed is:

1. An acoustic waveguide, comprising:

a first control curve;

a second control curve;

a third control curve;

a fourth control curve; and a continuous three-dimensional surface coincident with the first control curve, the second control curve, the third control curve and the fourth control curve;

where each of the first control curve, the second control curve, the third control curve, and the fourth control curve intersects a circular throat end and a non-elliptical closed control curve that defines a mouth, and the circular throat end is configured to be coupled to a driving unit such that acoustic energy generated by the driving unit is directed by the continuous three-dimensional surface;

where the continuous three-dimensional surface is configured as a least-energy-surface that provides a minimum change in curvature calculated by integrating a rate of change of local curvature over the entire surface.

2. The acoustic waveguide of claim 1, where the continuous three-dimensional surface is free of discontinuities.

3. The acoustic waveguide of claim 1, where the continuous three-dimensional surface further includes: a minimum surface area axial section plane of the continuous three-dimensional surface formed from the first control curve, second control curve, third control curve, and fourth control curve.

4. The acoustic waveguide of claim 3, where the minimum surface area axial section plane is at the circular throat end of the acoustic waveguide.

5. The acoustic waveguide of claim 1, where the first control curve is symmetrical about an axis with the second control curve.

6. The acoustic waveguide of claim 5, where the third control curve is symmetrical about the axis with the fourth control curve.

7. The acoustic waveguide of claim 1, where the non-elliptical closed control curve that defines the mouth is substantially rectangular.

8. A method for creation of an acoustic waveguide, comprising:

identifying a first control curve;

identifying a second control curve that mirrors the first control curve;

identifying a third control curve;

identifying a fourth control curve that mirrors the third control curve; and generating a least-energy-surface that is formed from the first control curve, second control curve, third control curve and fourth control curve, the least-energy-surface providing a minimum change in curvature calculated by integrating a rate of change of local curvature over the entire surface and intersecting a circular throat end and a non-elliptical closed control curve forming a mouth;

where the circular throat end is configured to be coupled to a driving unit such that acoustic energy generated by the driving unit is directed by the least-energy-surface.

9. The method of claim 8, where generating further comprises forming the least-energy-surface as a continuous surface minimizing the formation of any discontinuities.

10. An acoustic waveguide, comprising:

means for defining a first control curve;

means for defining a second control curve that mirrors the first control curve;

means for defining a third control curve;

means for defining a fourth control curve that mirrors the third control curve;

a least-energy-surface that is formed by the first control curve, second control curve, third control curve and fourth control curve, the least-energy-surface providing a minimum change in curvature calculated by integrating a rate of change of local curvature over the entire surface and intersecting a circular throat end and a non-elliptical closed control curve forming a mouth;

where the circular throat end is configured to be coupled to a driving unit such that acoustic energy generated by the driving unit is directed by the least-energy-surface.

11. The acoustic waveguide of claim 10, where the least-energy-surface further comprises a continuous surface minimizing the presence of discontinuities.

* * * * *